United States Patent [19]

Sun et al.

[11] Patent Number: 5,013,041

[45] Date of Patent: May 7, 1991

[54] GOLF DRIVER WITH VARIABLE WEIGHTING FOR CHANGING CENTER OF GRAVITY

[75] Inventors: Donald J. C. Sun, San Diego, Calif.; Wen J. Tai, Kaohsiung, Taiwan

[73] Assignee: Cipa Manufacturing Corporation, Kang Shan Kaohsiung, Taiwan

[21] Appl. No.: 468,087

[22] Filed: Jan. 22, 1990

[51] Int. Cl.[5] ..... A63B 53/04

[52] U.S. Cl. ..... 273/164; 273/173; 273/171; 273/167 A; 273/80 A

[58] Field of Search ..... 273/167-175, 273/77 A, 77 R, 164, 80 A

[56] References Cited

U.S. PATENT DOCUMENTS

| | | | |
|---|---|---|---|
| D. 248,181 | 6/1978 | Cervantes | 273/167 A X |
| 1,343,998 | 6/1920 | Grant | 273/169 |
| 1,453,503 | 5/1923 | Holmes | 273/171 |
| 1,558,703 | 10/1925 | Miller | 273/173 |
| 1,840,924 | 1/1932 | Tucker | 273/171 |
| 1,945,844 | 2/1934 | Young | 273/167 A X |
| 2,174,212 | 9/1939 | Newsome | 273/169 |
| 2,478,468 | 8/1949 | Drake | 273/167 A |
| 3,138,386 | 6/1964 | Onions | 273/167 A |
| 3,606,327 | 9/1971 | Gorman | 273/171 |
| 3,880,430 | 4/1975 | McCabe | 273/183 D |
| 3,979,122 | 9/1976 | Belmont | 273/171 |
| 3,997,171 | 12/1976 | Currie | 273/167 A |
| 4,145,052 | 2/1979 | Janssen et al. | 273/171 |
| 4,180,269 | 12/1979 | Thompson | 273/171 |
| 4,607,846 | 8/1986 | Perkins | 273/171 |
| 4,753,440 | 6/1988 | Chorne | 273/164 |

FOREIGN PATENT DOCUMENTS

| | | | |
|---|---|---|---|
| 194823 | 3/1923 | United Kingdom | 273/171 |
| 252995 | 6/1926 | United Kingdom | 273/171 |

*Primary Examiner*—Edward M. Coven
*Assistant Examiner*—Sebastiano Passaniti
*Attorney, Agent, or Firm*—Edward A. Sokolski

[57] ABSTRACT

A golf club head has a pair of parallel longitudinal chambers running thereacross behind the face plate. A set of weight members having various weights is provided. Such weight members are selectively installed in the chambers to vary the center of gravity of the club head both horizontally and vertically to modify the driving action of the club as may be desired.

5 Claims, 1 Drawing Sheet

GOLF DRIVER WITH VARIABLE WEIGHTING FOR CHANGING CENTER OF GRAVITY

BACKGROUND OF THE INVENTION

1. Field of the Invention

This invention relates to golf clubs and more particularly to a golf club driver head in which the center of gravity can be changed as desired to vary the driving characteristics thereof.

2. Description of Related Art

It is well known that the location of the center of gravity of a golf club head has a significant effect on the driving characteristics thereof, particularly with less skilled and experienced golfers. The expert can control the flight of the ball by controlled rotation of his hands to cause a spin or rotation to be imparted to the ball causing it to take a desired flight path. The less than expert golfer, however, is not able to exercise such control and generally relies on attempting to hit the ball so that impact with the club head is made at the "sweet spot" thereof which is generally located along a vertical line which runs directly opposite or through the center of gravity of the head. This tends to provide a straight shot without either "slice" (veering of the ball to the right) or "hook" (veering of the ball to the left). It has also been found that the loft angle the ball will take is affected by the position of the center of gravity of the club head vertically, a higher center of gravity generally making for a higher loft angle.

The above indicated effects of changing the center of gravity of golf club head are well known in the prior art. In prior art club heads such as described in U.S. Pat. No. 3,059,926 issued Oct. 23, 1962 to J. Johnstone, an entire set of clubs is provided, each being designed with a different center of gravity. Other prior art devices utilize weights which can be inserted in a club head for changing the weighting. No means is provided, however, in such prior art devices for precisely adjusting the center of gravity both vertically and horizontally in a single club head to suit each golfer's individual requirements and to change this center of gravity as the golfer's experience and golfing habits change, as in the present invention.

SUMMARY OF THE INVENTION

The device of the present invention is a golf driver head having a pair of chambers formed on the rear of the face plate. These chambers run laterally across the substantally the entire horizontal extent of the face plate and are substantially parallel to each other. A plurality of sets of weights which can be fitted into the chambers are provided. In the preferred embodiment such weights are all of approximately the same size, with the weights in each set being of a different material having a different weight. Thus, typically a set of aluminum, brass, and lead weights are provided, there being three weights in each set. The weights can be arranged in the two chambers in a variety of manners to shift the center of gravity to the right or left or up and down, as may be desired. Thus, for example, with all three of the weights of one set in one chamber and all three of the weights of another set in the other chamber, the center of gravity will be along a vertical center line at a particular position along this line. If the two sets of weights are interchanged, the position of the center of gravity along this vertical line will also change. A change of the center of gravity from the vertical center line can be achieved by inserting weights from different sets in the same chamber. It should be readily apparent that the center of gravity can be varied in this manner both horizontally and vertically in increments with changes in the positioning of the various weights in the two chambers.

It is therefore an object of this invention to provide a golf club head in which the center of gravity can be changed both vertically and horizontally to a variety of positions.

It is a further object of this invention to enable the center of gravity of a single golf club head to be changed both vertically and horizontally to a great variety of locations to suit particular requirements of an individual golfer.

DETAILED DESCRIPTION OF THE INVENTION

Figure 1:
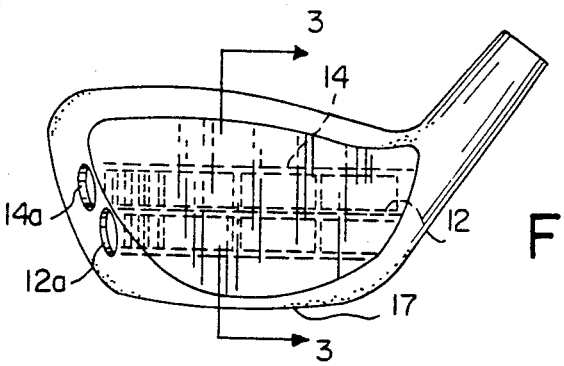
FIG. 1 is a front elevational view of a preferred embodiment of the invention.
Figure 2:
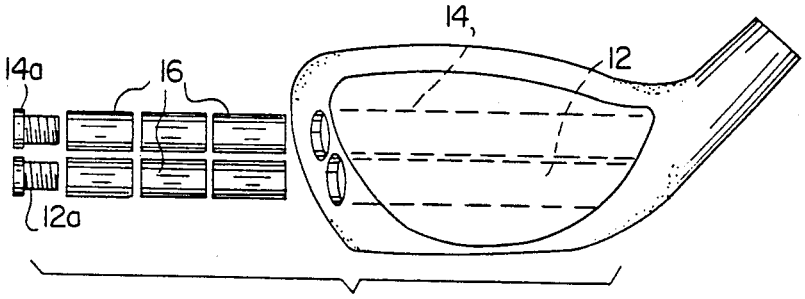
FIG. 2 is an exploded front elevational view of the preferred embodiment showing the weights removed from the chambers.
Figure 3:
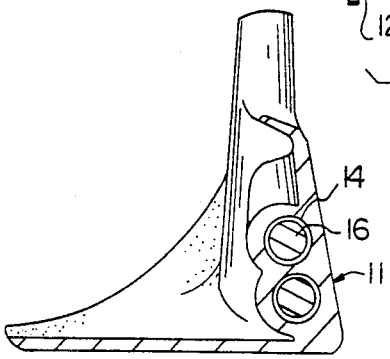
FIG. 3 is a cross sectional view taken along the plane inidicated by 3—3 in FIG. 1.
Figure 4:
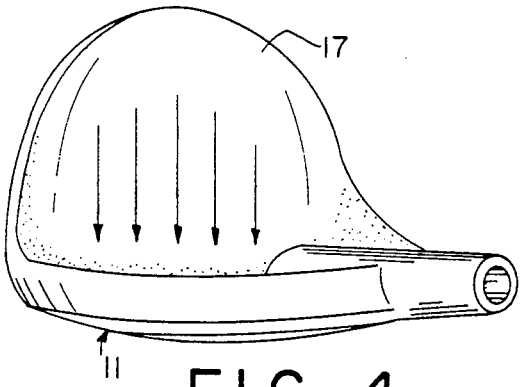
FIG. 4 is a top plan view of the preferred embodiment.
Figure 5:
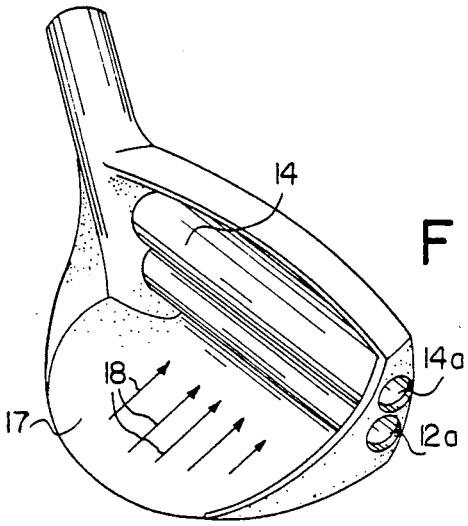
FIG. 5 is a perspective view of the preferred embodiment.

Referring now to the Figures, a preferred embodiment of the invention is illustrated.

The club head is made in a casting and has a face plate 11 which is affixed to such casting by suitable means such as welding. Formed in the casting immediately behind the face plate are a pair of tubular chambers 12 and 14 which run substantally the entire horizontal extent of the face plate and are substantially parallel to each other. A cap 12*a* and 14*a* is respectively provided for each of the chambers, these caps threadably attaching to their associated chamber walls. A plurality of cylindrical weight members 16 are provided, these weight members all being the same size. Three of such weight members are installed in each chamber at a time. A plurality of sets of such weight members are provided, each set including three such members and being made of a material having a different density. In the prefered embodiment three sets of such weights are provided , a first set being of aluminum(density-2.70), a second set being made of brass(density-8.50), and the third set being of lead(density-11.34).

The weight of the club head is typically 145–170 grams(without the weights inserted) and the center of gravity is typically located between chambers 12 and 14 and equidistant from the toe and heel of the head(without weights inserted). The chambers typically have inner diameters of 7.5–10 mm and lengths of 48–58 mm. The weights 16 have outer diameters corresponding to the inner diameters of the chambers and lengths of 16–19.3 mm. The club head casting is typically made of stainless steel.

As noted above, a great variety of different combinations of the weights can be used to provide a great variety of different centers of gravity for the club head. It is estimated that over 700 variations in center of gravity can be attained with the three sets of weights described above. To facilitate the use of the weights by the golfer, a table can be provided to indicate the expected effects on loft angle and slice and hook which will be influenced with various combined arrangements of the weights in the chambers to provide shifts in the center of gravity upwardly and downwardly and to the right and left.

Aim alignment markers 18 are placed on the top side of sole plate 17, directly behind the hitting face. This facilitates aiming and avoids the illusion as to the impact point often obtained when such markers are not this close to the hitting surface.

While the invention has been described and illustrated in detail, it is to be clearly understood that this is intended by way of illustration and example only and not by way of limitation, the scope of the invention being limited only by the terms of the following claims.

We claim:

1. In a golf club head having a sole plate and a face plate having front and rear surfaces extending upwardly substantially normally from said sole plate, said sole plate having opposing bottom and top surfaces, the improvement comprising:

first and second similarly dimensional chambers formed along the rear surface of said face plate, said chambers running substantially the entire horizontal extent of said face plate in side by side substantially parallel relationship to each other, a plurality of sets of weight members, all of said weight members having the same dimensions which enable a plurality of said weight members to be fitted into said chambers, the weight members of each set being of a different density material, one end of each of said chambers being permanently closed, and removable cap means for removably capping the other ends of said chambers to retain the weights therein, said weight members being selectively installable in said chambers to variably shift the location to the center of gravity for said club head, both vertically and horizontally, said weight members being removable for replacement by means of said removable cap means.

2. The golf club head of claim 1 wherein said weights are cylindrical in shape, said chambers having cylindrical inner surfaces with a diameter substantially equal to the outside diameter of said weights.

3. The club head of claim 1 wherein there a three weights in each set thereof.

4. The club head of claim 1 wherein there are three sets of said weights, the weights of one of said sets being made of aluminum, the weights of another of said sets being made of brass and the weights of the third of said sets being made of lead.

5. The club head of claim 1 and further including a plurality of sighting arrows formed on the top surface of said sole plate, said arrows running towards the rear surface of said face plate in a direction substantially normal thereto.

* * * * *